United States Patent [19]

Bisson

[11] Patent Number: 4,712,494

[45] Date of Patent: Dec. 15, 1987

[54] AUTOMATIC EXCHANGE OF THE SIZE IN AN AUTOMATIC SEWING UNIT

[75] Inventor: Flavio Bisson, Cava Manara Pv, Italy

[73] Assignee: Necchi Societa per Azioni, Pavia, Italy

[21] Appl. No.: 31,195

[22] Filed: Mar. 27, 1987

Related U.S. Application Data

[63] Continuation of Ser. No. 913,315, Sep. 30, 1986, abandoned.

[30] Foreign Application Priority Data

Sep. 30, 1985 [IT] Italy ..... 42912-A/85

[51] Int. Cl.[4] ..... D05B 21/00; D05B 3/04

[52] U.S. Cl. ..... 112/121.12; 112/121.14; 112/121.15

[58] Field of Search ..... 112/121.12, 121.11, 112/121.14, 121.15

[56] References Cited

U.S. PATENT DOCUMENTS 4,006,698 2/1977 Scholl et al. ..... 112/121.14 X
4,312,283 1/1982 Fischer et al. ..... 112/121.12
4,455,952 1/1984 Morin et al. ..... 112/121.15 X
4,494,470 1/1985 Fischer et al. ..... 112/121.14 X
4,512,271 4/1985 Herdeg et al. ..... 112/121.12 X
4,632,046 12/1986 Barrett et al. ..... 112/121.14

*Primary Examiner*—H. Hampton Hunter
*Attorney, Agent, or Firm*—Stevens, Davis, Miller & Mosher

[57] ABSTRACT

Automatic exchange of the size in an automatic sewing unit which comprises a sewing machine displaceable along two axes and a workpiece clamp group formed by at least two half-clamps, one of which is fixed and the other of which is mobile. In order to obtain different desired sizes, the machine, positioned at a basic size $\phi$ corresponding to the position $\phi$ of the axis, is automatically displaced in a positive way for reading the displacement made by the mobile half-clamp. The size is obtained as the difference between the trigger coordinate of a proximity fixed to the sewing machine and a memorized fixed coordinate corresponding to the basic size $\phi$.

4 Claims, 3 Drawing Figures

AUTOMATIC EXCHANGE OF THE SIZE IN AN AUTOMATIC SEWING UNIT

This application is a continuation of application Ser. No. 913,315 filed Sept. 30, 1986 and now abandoned.

DISCLOSURE OF THE INVENTION

The present invention relates to an automatic sewing unit and more precisely to an automatic exchange of the size in an automatic sewing unit for sewing collars or cuffs.

In automatic units having a cam reproducing the contours of the collar or the cuff, for changing the size, the operator handles a hand-wheel which acts on the cam in such a way as to increase or to reduce the contours of the collar or cuff. The fabric supporting frame which is automatically displaced under the sewing head is replaced with a frame corresponding to the new size. In these types of automatic units, the exchange of the size requires a long time and a set of frames is necessary for each different size. As a consequence, the costs are consistently high because the inoperative time of the machine which cuts down on production due to storing and changing of the different frames.

With the introduction of electronics in the automatic units, the cam has been replaced by EPROM (ERASEABLE PROGRAMABLE READ ONLY MEMORY), the frame divided in two half-clamps and the sewing machine displaceable along a predetermined path. When the size is changed, the operator handles a hand-wheel which displaces a half-clamp with respect to the other one until the desired size is obtained, reads on a scale the displacement effected with reference to the basic size and inserts the value of this displacement into the numeric control of the sewing machine. This will execute a path according to the new values. If the reading of the operator has not been executed with precision or if the data fed into the numeric control are not correct, during the sewing cycle, the machine executes a size profile different from the one predetermined on the half-clamps. As a consequence an imperfect sewing of the fabric piece occurs and in the worst case, there is a breakage of the sewing means (needle) which strike a half-clamp and in case a phase-displacement of the machine. All of this weighs on the production charges.

It is the purpose of the present invention to overcome the above-described drawbacks.

The technical problem to be solved was to realize an automatic exchange of the size without the operator reading and/or feeding the new size values into the numeric control of the automatic sewing unit.

The solution of the technical problem is characterized by the fact that the machine positioned on a basic size $\phi$ corresponding to the $\phi$ position of X, Y axis is automatically displaced in a positive way along one of said axes, in order to read the value of the displacement effected by the mobile half-clamp, means being provided for pointing out and memorizing the absolute value of the axis.

Figure 1:
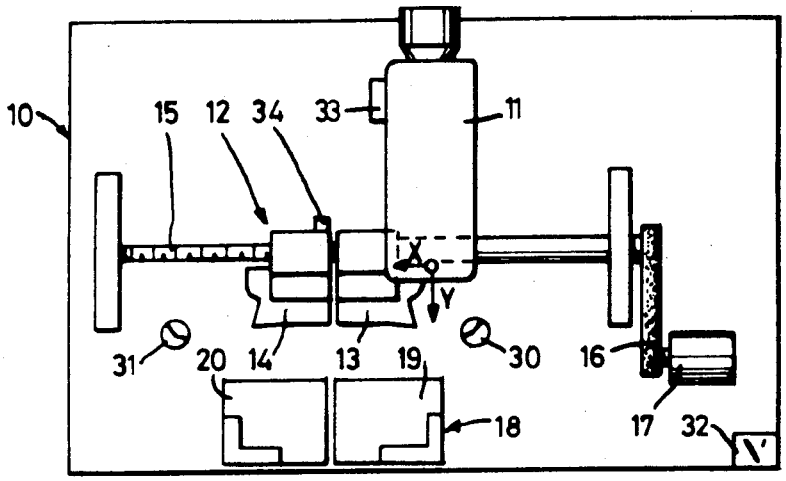
Figure 3:
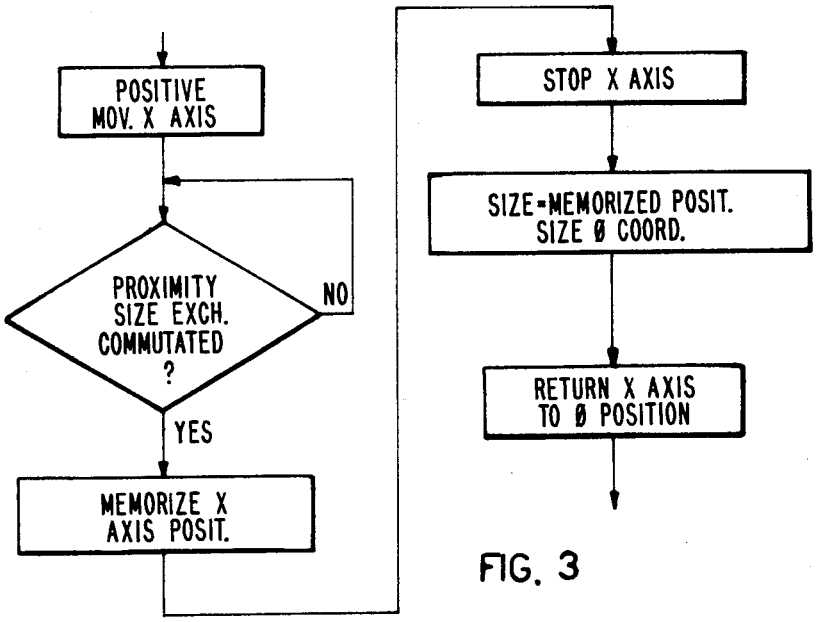
Figure 2:
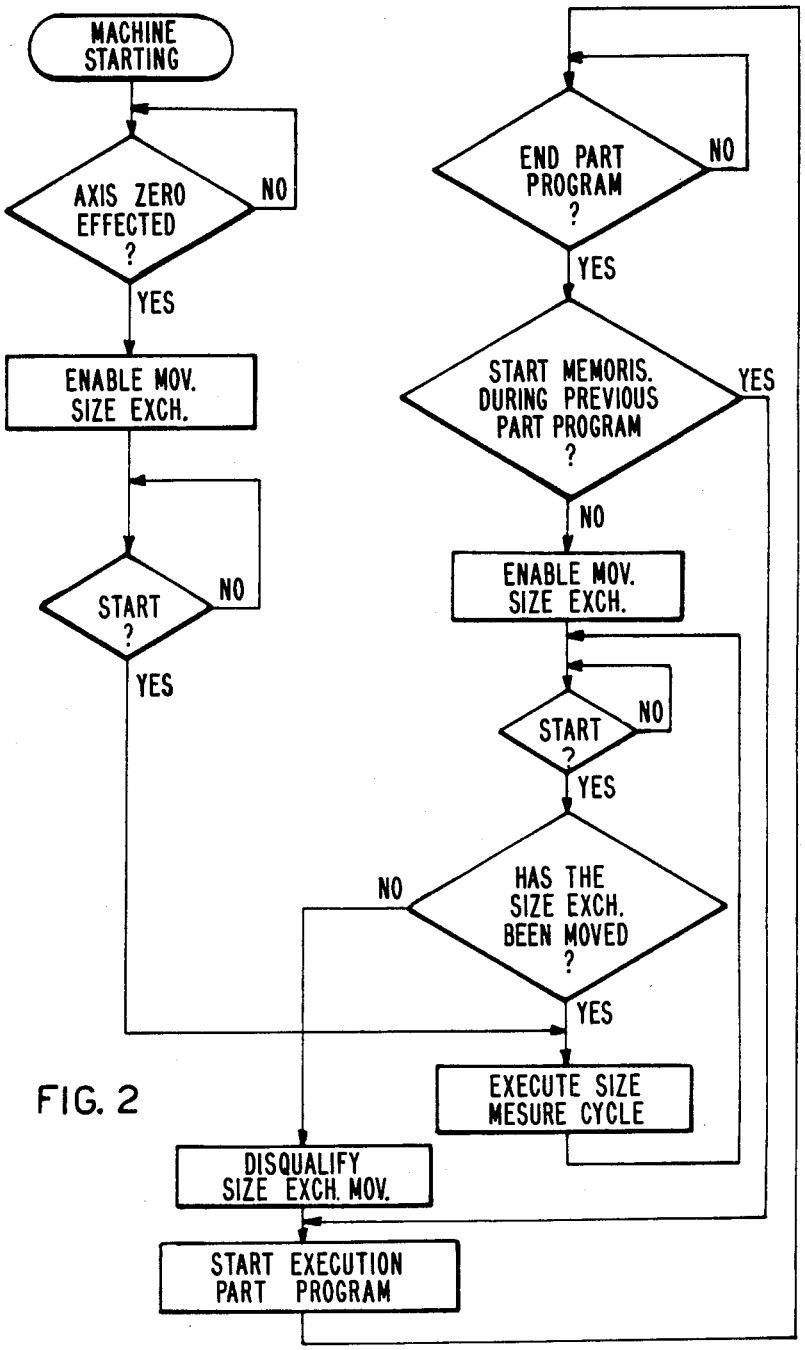

Other details and features of the invention will stand out from the description given below by way of non-limitative example and with reference to the accompanying drawings, in which:

FIG. 1 is a top plan view of the automatic unit to which the automatic exchange of the size, object of the present invention, is applied, and FIGS. 2 and 3 represent flow charts of the automatic sewing unit when the size is varied.

With reference to FIG. 1, it is indicated in a generic way with 10 an automatic sewing unit for sewing collars, comprising a sewing machine 11 which automatically moves in a known way along the X, Y axis in order to follow the contours of clamp set 12 composed by a fixed half-clamp 13 and by a half-clamp 14 displaceable along the X axis by means of a worm-screw 15, driven, via a belt 16, by a motor 17 in order to obtain the size exchange as will be hereafter explained.

The automatic unit 10 comprises also a fabric loader 18 formed by two half-plates 19 and 20 fixed and mobile respectively. A point-cutter 30 is connected to the fixed half-plate 19 and a mobile point-cutter 31 to the mobile half-plate 20. The half-plate 20 and the point-cutter 31 are displaced along the X axis when the size is changed and the half-clamp 14 is displaced. The displacement of said half-clamp 20 and of the said point-cutter 31 is operated by the motor 17 via a belt not shown in the drawings. For the automatic exchange of the size, the operator, acting on a switch 32 (FIG. 1), starts the motor 17, which, through the belt 16—worm screw 15, displaces the half-clamp 14 along the X axis. The accomplishment of the displacement of the half-clamp 14 occurs in an automatic way by means of the numeric control. This has been obtained by using the same X axis as a measure system letting it move in a positive way from the $\phi$ position of both X, Y axis until a proximity 33, situated on the machine 11, is commutated by a metallic block 34 fixed to the half-clamp 14.

In this position (FIGS. 2 and 3) the numeric control memorizes the absolute value of the X axis and then carries the axis back on the $\phi$ value. The size is obtained in the numeric control as the difference between the trigger coordinate of the proximity 33 and a fixed coordinate memorized in the EPROM corresponding to the $\phi$ size.

In the phase of the starting of the automatic unit 10 it is only necessary to control that, when the apparatus is positioned on the $\phi$ size. Also the numeric control detects the $\phi$ size, that is, during the measure cycle the proximity 33 must commutate, only with the value of the X axis coordinate written in the EPROM.

The movement of the apparatus for the size exchange by the switch 32 is brought about by the numeric control by means of an appropriate output signal only under safety conditions. At the switching on, after having executed the zero axes, the numeric control brings about the movement of the size exchange and at the first start a size measure cycle is always effected followed by the Part Program while the enabling of the size exchange is removed. The Part Program is the instructions in the EPROM that define the seam tracing.

At the end of each execution of the Part Program, if a start, during the execution of the Part Program, has not been memorized, the numeric control enables the movement of the size exchange and verifies, through an appropriate input signal, if the size exchange is moved. When the start is given, if the size exchange has been moved, a size measure cycle is executed, otherwise the size exchange is not activated and the Part Program executed.

What is claimed is:

1. An automatic exchange of the size in an automatic sewing unit comprising a sewing machine displaceable along two axes and a workpiece clamp group formed by at least two half-clamps of which one is fixed and the other mobile in order to obtain different sizes, comprising a machine positioned on a basic size $\phi$, corresponding to the $\phi$ position of said axes, automatically movable in a positive way along one of said axes, for reading the displacement effected by said mobile half-clamp, and means for pointing out and memorizing the absolute coordinate of said axes.

2. The automatic exchange of the size according to claim 1 wherein said means comprise a proximity situated on said sewing machine and a block fixed to said mobile half-clamp.

3. The automatic exchange of the size according to claim 2 wherein the size is obtained as a difference between the trigger coordinate of said proximity and a memorized fixed coordinate corresponding to said basic size $\phi$.

4. The automatic exchange of the size according to claim 3 including a Part Program and a numerical control, wherein at the end of each execution of the Part Program, if it has not been memorized a start during the execution of the Part Program, the numerical control enables the movement of the size exchange and verifies through an appropriate input signal if the size exchange is moved, and that, when the start is given, if the size exchange has been moved, a cycle of size measure is executed, otherwise the size exchange is no more enabled and the Part Program is executed.

* * * * *